US006873289B2

(12) United States Patent
Kwon et al.

(10) Patent No.: US 6,873,289 B2
(45) Date of Patent: Mar. 29, 2005

(54) 3-DIMENSIONAL BEAM STEERING SYSTEM

(75) Inventors: Young-Woo Kwon, Kyungki-do (KR); Chang-Yul Cheon, Seoul (KR)

(73) Assignee: Seoul National University, Seoul (KR)

( * ) Notice: Subject to any disclaimer, the term of this patent is extended or adjusted under 35 U.S.C. 154(b) by 0 days.

(21) Appl. No.: 10/209,991

(22) Filed: Jul. 31, 2002

(65) Prior Publication Data

US 2003/0034916 A1 Feb. 20, 2003

Related U.S. Application Data

(60) Provisional application No. 60/312,947, filed on Aug. 15, 2001.

(51) Int. Cl.[7] ..... H01Q 3/24

(52) U.S. Cl. ..... 342/372; 343/700 MS; 343/757

(58) Field of Search ..... 342/359, 372; 343/700 MS, 766, 765, 754, 757–758

(56) References Cited

U.S. PATENT DOCUMENTS

| | | | | | |
|---|---|---|---|---|---|
| 2,227,563 | A | * | 1/1941 | Werndl | 342/371 |
| 5,594,460 | A | * | 1/1997 | Eguchi | 343/765 |
| 6,169,522 | B1 | * | 1/2001 | Ma et al. | 343/757 |
| 6,239,744 | B1 | * | 5/2001 | Singer et al. | 342/359 |
| 6,611,696 | B2 | * | 8/2003 | Chedester et al. | 342/359 |
| 6,657,589 | B2 | * | 12/2003 | Wang et al. | 342/383 |

* cited by examiner

*Primary Examiner*—Thomas H. Tarcza
*Assistant Examiner*—Fred H Mull
(74) *Attorney, Agent, or Firm*—Fulbright & Jaworski LLP

(57) ABSTRACT

The present invention relates to a beam steering system. The system includes an array of a plurality of antenna elements, each antenna element being electrically and mechanically controlled for steering a beam in a specific direction, and a millimeter wave subsystem quasi-optically integrated with a 3-dimensional beam steering device and an MMIC-type active circuit. The antenna element is controlled in real time by an electrical driving method so as to be moved in 2-dimensional space. That is, in the 3-dimensional system of the present invention, the beam is electrically controlled by a phase shifter, and each antenna element is physically moved by a mechanical driving mechanism. The 3-dimensional beam steering antenna and the associated devices are monolithically integrated on a substrate using MEMS technology, and the active circuit elements such as a mixer, a power amplifier (PA), a low noise amplifier (LNA), a VCO, etc. are integrated in an MMIC active array. The 3-dimensional beam steering device and the active MMIC circuit are integrated into one system by being interconnected using the quasi-optical technique. According to the present invention, shortcomings of the millimeter wave in that the SNR is low due to the low device output and high transmission loss in the free space can be overcome using the new RF transmission technique of 3-dimensional beam steering, and by introducing a micro antenna structure which is electrically and mechanically controlled such that wideband RF communication and 3-dimensional imaging is allowed in a Pico cell environment.

10 Claims, 5 Drawing Sheets

3-DIMENSIONAL BEAM STEERING SYSTEM

CROSS REFERENCE TO RELATED APPLICATIONS

This application is based on provisional application Ser. No. 60/312,947, filed on Aug. 15, 2001.

BACKGROUND OF THE INVENTION (a) Field of the Invention

The present invention relates to a radio communication system, and in particular, to a 3-dimensional beam steering antenna system for focusing a radio beam at one spatial point so as to maximize signal transmission efficiency.

(b) Description of the Related Art

A new frequency resource, "millimeter-wave", has a broad frequency band of 30~300GHz and is emerging to cover future requirements of high speed multimedia communication applications.

For example, millimeter-wave systems' like LMDS and wireless LAN have been developed for 30 GHz, 60 GHz, etc. millimeter wave band communication services.

The millimeter wave technology also has important characteristics for imaging applications. The conventional imaging techniques use optical and microwave bands. If a new conceptual 3-dimensional imaging technology is developed in the millimeter wave band, it can be applied to various technical fields requiring high resolution 3-dimensional images, such as medical and engineering fields.

In spite of these merits, use of millimeter waves has a technical problem in that the output power of a millimeter wave-generating device is extremely limited because the device output power is inversely proportional to a square of a frequency according to the $pf^2$ law, as shown in FIG. 1.

Also, compared with microwave technology, the millimeter wave technology is quite complex because of a very short wavelength, a high path loss, serious fading effects, and complex propagation characteristics which can contribute great difficulty in technology development thereof.

According to these shortcomings of the millimeter wave, received signals become weak as the frequency increases. Also, the millimeter wave technology has shortcomings in view of noise. Device gains of active devices used in a transceiver decrease and its noise factors increase, as the frequency increases. That is, the active device increases noise simultaneous with amplification of the signal. Accordingly, it is inevitable that the signal to noise ratio (SNR) is degraded when the signal passes through the active device. SNR is a significant factor for implementing radio communication systems such that the SNR should be lower than a threshold level for reliable data communication.

For overcoming these shortcomings of millimeter wave technology, a great deal of research has been undertaken around the world. However, most of it has focused on decreasing the noise at the device level and increasing the output power of the device. Another focus of research has been to decrease the interconnection loss between components and increase antenna gain by adapting a smart antenna system using a phased array.

To reduce the noise factor of the millimeter wave, however, a length of a gate should be reduced to 0.1~0.2 $\mu$m through an e-beam lithography process, which is expensive. In spite of a reduction of the length of the gate to 0.1~0.2 $\mu$m, SNR enhancement is only expected to an extent of about 1~2dB. Also, to increase antenna gain, a physical size of the antenna should be increased. The increase of antenna size causes many problems in system construction, as well as increasing manufacturing costs.

Also, using superconductors can be considered for reducing loss. But in this case, the expected enhancement is still only about 1~2dB.

The smart antenna system forms a two-dimensional beam and steers the beam, and this is a prior art technology of the 3-dimensional beam steering system of the present invention. Many research laboratories around world have devoted years of experience and research to the smart antenna system such that reception-signal-detecting antennas for a low frequency system can be commercialized so as to be used in mobile communication systems. However, the utilization of the smart antenna manufactured at the present technology level to the base station has both economical and communication quality problems. These problems may not be substantially solved using the conventional and presently-studied smart antenna technologies that depend on sensing a 2-dimensional direction. Also, a notable enhancement of the SNR of millimeter wave communication cannot be expected with this kind of approach in view of the Friis formula in which the power of the received signal is proportional to the antenna gain and inversely proportional to the square of the distance between the transmitter and receiver.

SUMMARY OF THE INVENTION

The present invention has been made in an effort to solve the above problems of the prior art.

It is an object of the present invention to provide a 3-dimensional beam steering system for wideband radio transmission by overcoming low SNR problems.

To achieve the above object, the 3-dimensional beam steering system comprises at least two beam steering devices, each including an antenna unit and an individual driving unit capable of electrically and mechanically steering the antenna unit.

A phase shifter for electrically adjusting a phase of a signal to be transmitted through the antenna unit is connected to the beam steering device. An MMIC-type active circuit, exchanging signals with the beam steering device, is preferably integrated with a VCO, a mixer, an amplifier, etc. so as to constitute a whole RF transmitting and receiving system. The MMIC-type active circuit and beam steering device can be monolithically integrated using quasi-optical technology or multi-level integration technology.

The theoretical background of the 3-dimensional beam focusing antenna is based on the Friis formula.

The Friis formula is adapted to the general RF transmission system, in which the receiving power is proportional to the transmitting power and respective antennas gains, and is inversely proportional to the square of the distance between the transmitting and receiving terminals.

According to the formula, in order to increase the receiving power to 10 times higher with the same distance, the transmission power or the antenna gain must be increased to as much as 10 times the original value.

Increasing the transmission power is limited in accordance with the $pf^2$ law such that it is unreasonable to increase the transmission power in view of commercialization because the cost per unit power exponentially increases. Even though the transmission power may be increased with an epoch-making technology, high energy consumption causes problems in the RF environment. Also, the transmission power increase requires high capacity batteries having a large size, resulting in increasing the size of the terminal.

Also, to increase the antenna gain to 10 times, it is required to make the antenna 10 times larger.

In consideration with the above theory, it is shown to be impossible to increase the receiving power over a Friis formula based receiving power with a fixed transmission power and antenna size. However, this is because of the consideration of the 2-dimensional transmission techniques in which the beam from the antenna is controlled in relation with the direction. Otherwise, if the beam is controlled such that the beam is 3-dimensionally focused at one point, i.e. the receiving antenna is controlled by fine phase control, the receiving power problem based on the Friis formula can be overcome.

Well known is the smart antenna system which uses the beam of the antenna. The smart antenna system is one of the phase array antenna systems in which a plurality of antenna elements are spatially arranged, wherein each successive antenna element shifts phase of the signal before transmission, such the antenna has a composite effect in a target direction. The smart antenna system is a 2-dimensional beam steering system that can change the directionality of its radiation patterns without changing a distance resolution power. The presently used phase array antennas are fixed on a flat plane. This is why the manufacturing processes are simple so as to allow mass-production of the phase array antenna system consisting of hundreds of antenna elements. In this case, however, the antenna elements are fixed, the direction of the whole beam differs from the direction of each antenna in which the antenna can obtain maximum gain in view of respective antenna elements, resulting in reduction of electrical characteristics. Until recent years, cost barriers have prevented their use in commercial systems. The advent of MEMS technology has allowed the development of a plurality of antenna elements that can be mechanically rotated, and that can be manufactured in a batch process with low manufacturing costs. This enables each individual antenna element to obtain the maximum gain by changing its directionality.

BRIEF DESCRIPTION OF THE DRAWINGS

The accompanying drawings, which are incorporated in and constitute a part of the specification, illustrate an embodiment of the invention, and together with the description, serve to explain the principles of the invention.

DETAILED DESCRIPTION OF THE PREFERRED EMBODIMENTS

A preferred embodiment of the present invention will be described hereinafter with reference to the accompanying drawings.

Figure 1:
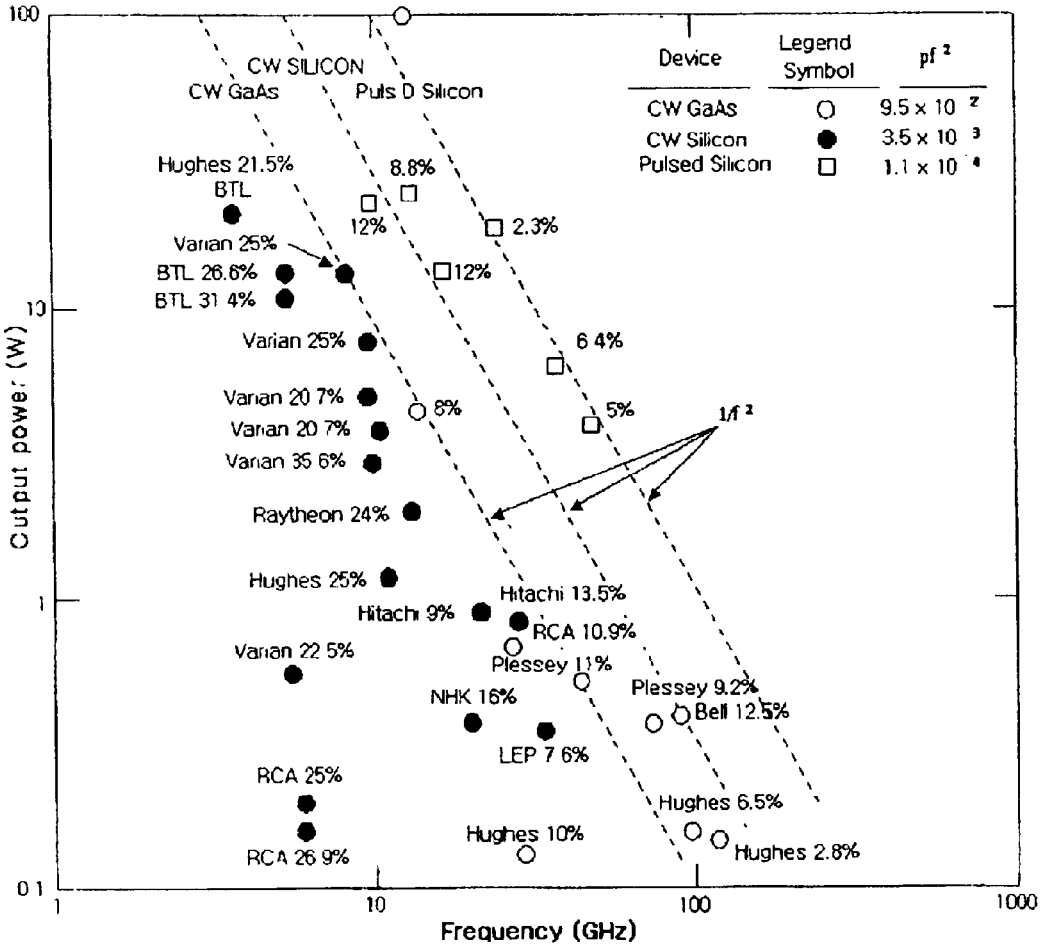
FIG. 1 is a graph illustrating frequency-to-output power ratios of respective microwave and millimeter wave sources.
Figure 2A:
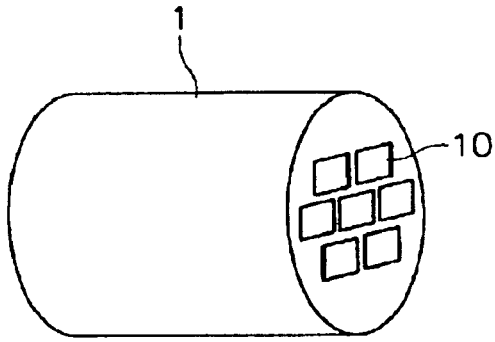
FIG. 2*a* is a perspective view showing a 3-dimensional beam focusing antenna system according to a preferred embodiment of the present invention.

FIG. 2*a* is a perspective view illustrating a 3-dimensional beam focusing antenna system.

As shown in FIG. 2*a*, an antenna system 1 has a cylindrical contour and includes a plurality of antenna elements 10 on a front surface thereof. Even though seven antenna elements 10 are arranged in a matrix form in this embodiment, the number and formation of the antenna elements 10 can be changed or modified. For example, ten antenna elements can be concentrically arranged.

Figure 2B:
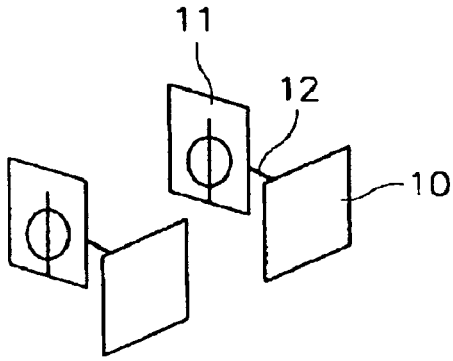
FIG. 2*b* is a perspective view showing an antenna element of the 3-dimensional antenna system of FIG. 2*a*.

FIG. 2*b* shows an antenna element of the 3-dimensional antenna system of FIG. 2*a*.

The antenna element 10 includes a driving unit 12 for 3-dimensionally rotating the antenna element 10, and a phase shifter 11 for controlling the phase of a signal to transmit through the antenna element 10.

The antenna elements 10 and the driving unit 12 are integrally manufactured using a micro-electro-mechanical system (MEMS) technology together with a micro mirror manufacturing technology.

Figure 3:
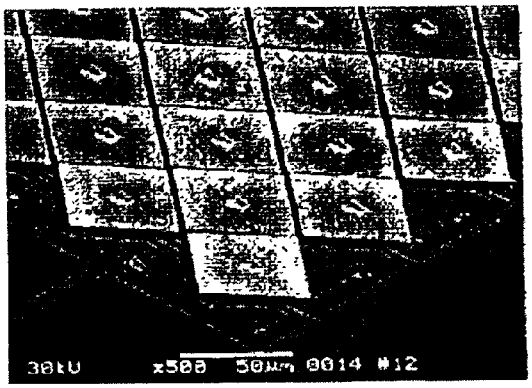
FIG. 3 is a photograph of a micro mirror.

FIG. 3 is a photograph of a micro mirror. The micro mirror is a device for reflecting light so as to guide the light by mechanically controlling the direction of the mirror according to a driving signal. A patch antenna of the present invention is similar to the micro mirror in structure such that the micro mirror technology can be used in the present invention. In this, a case 2-dimensional mechanical steering antenna array can be implemented using a Micro-Elevator by Self-Assembly (MESA) process, which is proposed by UCLA professor, M. C. Wu.

For implementing the 3-dimensional RF beam steering, a high accuracy angle and distance resolving power is required, which is obtained using the phase shifter 11.

The phase shifter 11 is a significant component in a beam steering unit of the phase array system and is implemented using PIN diodes or Schottky diodes in general. In the case of using the PIN diodes or Schottky diodes, there can be a considerable loss in the high frequency band, particularly in the millimeter wave band over 30 GHz. In order to minimize the loss in the millimeter wave band and maximize the efficiency, a new type of low loss phase shifter applying the MEMS technology is designed and implemented in the present invention. Unlike the conventional phase shift using diodes, the micromachined phase shifter implemented according to the present invention mechanically shifts phase by dimension of a transmission line using the MEMS technology. Since this kind of mechanical phase shift uses conductors rather than semiconductors, it is possible to significantly reduce loss and continuously adjust the phase displacement amount. Accordingly, the micromachined phase shifter is regarded as an optimal device for implementing the phased array capable of steering a beam in a required direction in the millimeter wave band.

Now, how the 3-dimensional beam focusing antenna system of the present invention can obtain the superior transmission efficiency will be described.

Generally, an electromagnetic wave is attenuated by a conductor loss caused by the skin effect, a radiation loss caused by imperfection of a dielectric. substance, and a radiation loss caused by a radiation of electric waves. As an operational frequency increases, these losses abruptly increase such that the conventional coaxial cable or waveguide cannot be an efficient transmission medium. The electric wave attenuation of the conductor and dielectric losses is expressed by a function $e^{-oz}$ (Z is propagation distance) such that the attenuation abruptly increases as the propagation distance become longer, even with a small attenuation constant $\alpha$. In order to avoid this attenuation and guarantee an efficient transmission over a long distance, a free-space propagation method is used for long distance communication. In the case of assuming transmission under an ideal vacuum state, since the power of the electric wave attenuates according to $$\frac{1}{r^2}$$

(r: distance), the attenuation amount relatively decreases. However, since the electric wave is scattered in all directions when a non-directional antenna is used, a high directional antenna having a large gain and being capable of focusing the beam for a point-to-point link is used. An RF system implemented by applying the low loss free-space transmission and beam focusing techniques for interconnection is called a quasi-optical RF system.

In the case of implementing the quasi-optical RF system in the millimeter wave band, there is an advantage in that the interconnection loss is smaller than in the case of using the conventional coaxial cable or waveguide as a transmission line, resulting in enhancement of the SNR.

In RF communication, a link budget is calculated using the Friis formula that is expressed as follows.

$$P_r = P_t \frac{G_t G_r \lambda^2}{(4\pi r)^2}$$

where $P_r$ is a receiving power, $P_t$ is a transmitting power, $G_t$ is a receiving antenna gain, $G_t$ is a transmitting gain, and r is a distance between a transmitter and a receiver.

The above equation is valid under the assumption of a far field in which a focal distance is infinite, and of an assumption of a plane wave.

The above equation is characterized in that no matter what the antenna gain is, the receiving power is inversely proportional to the square of the distance.

Using the 3-dimensional beam steering technique of the present invention, it is possible to control a focus in a longitudinal direction as well as in a transverse direction such that the Friis formula based on the 2-dimensional plane becomes insignificant, and it is possible to obtain receiving power regardless of the distance in the case that an effective area of the receiving antenna is greater than a waist area of the beam.

According to Gaussian beam theory, the waist of the beam on the assumption of a Gaussian beam can be expressed as the following equation.

$$w_{02} = \frac{\lambda}{\pi} \frac{f}{w_{01}}$$

where $w_{01}$ is a radius of a lens, $w_{02}$ is a radius of the waist at a focal point, and r is a distance to the focal point.

In this equation, if a transmitting array antenna having a 10 cm radius and operating at 100 GHz is used and a receiving antenna having a 10 cm radius locates at the focal point 10 m away from the transmitting antenna, most of the beams can be received by the receiving antenna. That is, the 3-dimensional beam steering technique can overcome the limitation of the Friis formula as a basic RF communication rule where the receiving power decreases by $1/r^2$.

Figure 4:
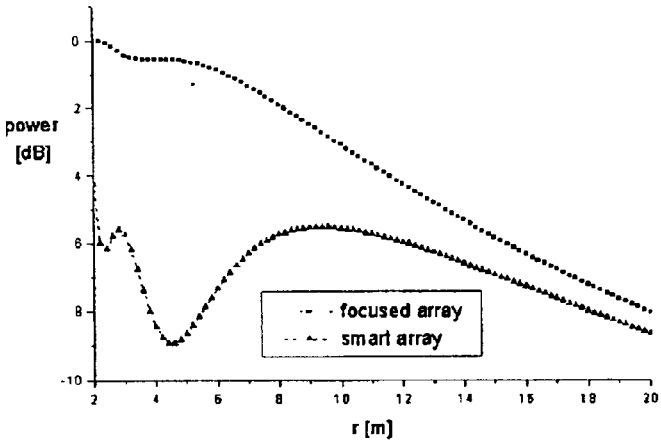
FIG. 4 is a graph illustrating received power with respect to distance in the 3-dimensional beam focusing antenna system of the present invention and a conventional phased array antenna.

To verify this theory, an antenna system was structured by arranging 25 patch antennas in a 5×5 matrix format on a 22×22 plate, and it was compared with a conventional antenna system in performance. FIG. 4 shows a result of the comparison between the 3-dimensional beam steering antenna system and the conventional 2-dimensional phased array system in receiving power in relation with the distance. Here, the size of the receiving antenna was 8 cm ×8 cm.

In the smart antenna system, the antenna array is arranged on a plane such that the direction of the beam can be tilted in a range of 70 degrees. However, all the antenna elements of the array in this system are physical fixed such that the direction of the whole beam differs from the direction of each antenna to which the antenna can obtain maximum gain in view of respective antenna elements.

In the case of the general patch antenna, there is a gain loss over 6 dB when the beam is oriented to a 60° vertically declined direction. Accordingly, if each antenna element can be controlled so as to adjust its direction, it is possible to obtain the maximum gain regardless of the direction of the antenna system.

Figure 5:
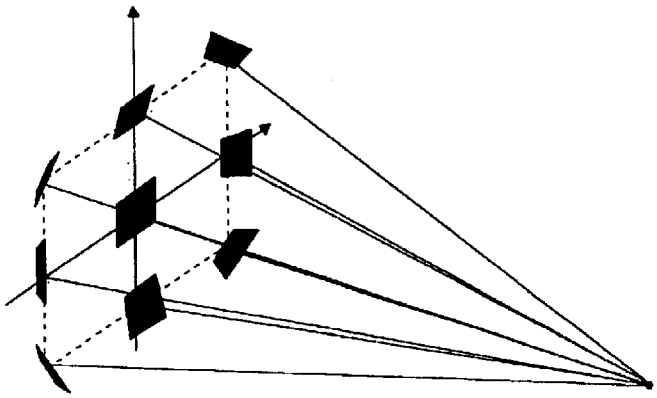
FIG. 5 is a conceptual view for illustrating how an antenna array of the 3-dimensional beam focusing antenna system is mechanically controlled.

FIG. 5 shows an antenna array of which respective antenna elements are controlled so as to 3-dimensionally focus the beams at one point. To adjust the direction of each antenna element, the antenna element is driven by electrostatic or magnetostatic force using the MEMS technology. In the present invention, the power-receiving signal can be maximized using the electrical phase shifting technique and the mechanical antenna element direction control technique so as to transmit the 3-dimensional beam.

In this antenna system, respective antenna elements are individually controlled such that this 3-dimensional beam steering technique can be used in the microwave and millimeter wave bands regardless of the frequency.

Figure 6:
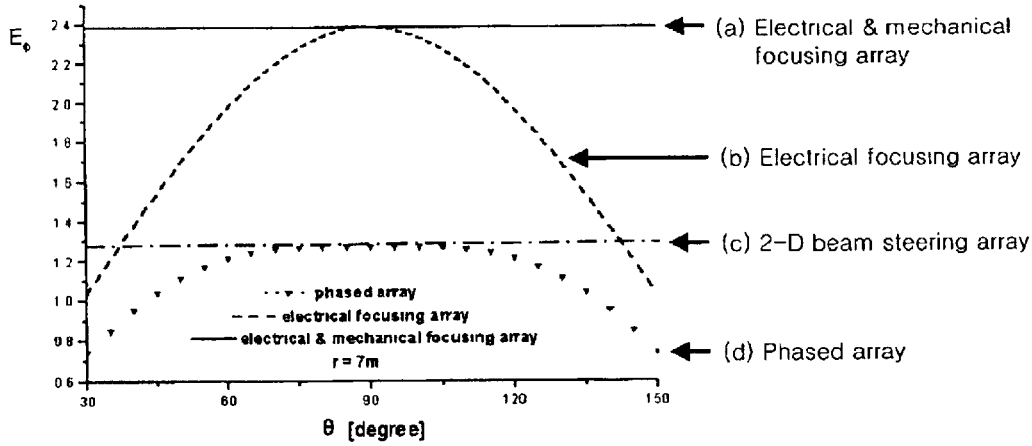
FIG. 6 is a graph illustrating power of radiation electric fields on an E-plane in cases of using electrical and mechanical 3-dimensional beam focusing, electrical 3-dimensional beam focusing, mechanical 2-dimensional beam steering with respect antenna units, and a 2-dimensional phased array.

FIG. 6 is a graph illustrating powers of radiation electric fields in cases of using electrical and mechanical 3-dimensional beam focusing (a), electrical 3-dimensional beam focusing (b), mechanical 2-dimensional beam steering with respect antenna units (c), and a 2-dimensional phased array (d).

As shown in FIG. 6, the case (a) according to the present invention shows improvement by as much as 3 dB to 10 dB with respect to the conventional techniques (b) and (d) in the power of the receiving signal relative to direction. Also, the technique (c) of the mechanical 2-dimensional steering shows it has the characteristics superior to the technique (d) of the conventional 2-dimensional phased array. This test shows that the system in which the respective antenna elements are individually and mechanically controlled has superior characteristics to the conventional system in which all the antenna elements are fixed, regardless of the dimension (1, 2, or 3D).

Figure 7:
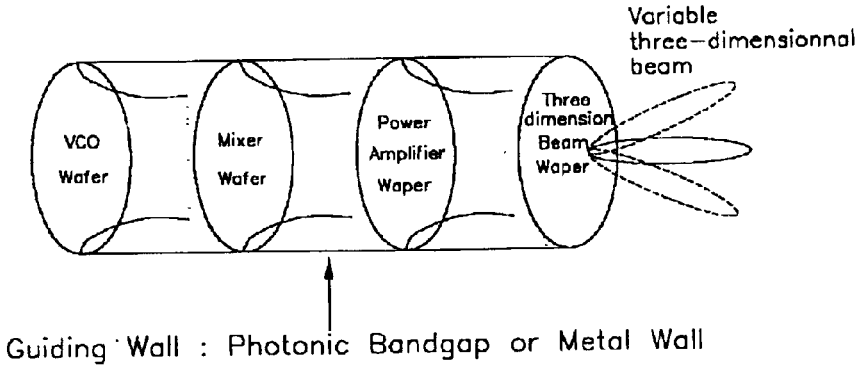
FIG. 7 is a conceptual view illustrating a quasi-optically integrated 3-dimensional millimeter wave subsystem.

FIG. 7 shows an exemplary subsystem implemented by quasi-optically integrating a beam steering device and an active MMIC circuit.

A carrier signal is generated from a voltage controlled oscillator (VCO) acting as a signal generator, and transferred to a mixer wafer through a guiding wall. This bas-band signal is modulated into a high frequency signal by the mixer wafer and then transferred to a power amplifier wafer. Consequently, the high frequency signal is amplified by the power amplifier wafer and is then broadcasted thorough the air. The guiding wall can be made of a photonic bandgap material or a metal.

Figure 8:
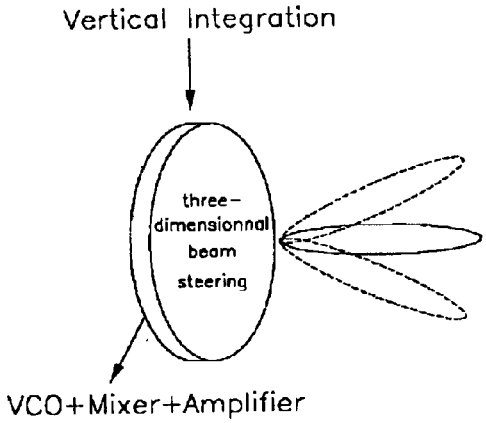
FIG. 8 is a conceptual view illustrating a monolithically integrated multilevel integrated 3-dimensional millimeter wave subsystem.

FIG. 8 shows a 3-dimensional millimeter wave subsystem integrated in a multilevel monolithic manner. This is a newly proposed technique for integrating devices by applying a bulk micromachining technology.

The 3-dimensional RF transmission technique proposed in the present invention solves the shortcomings of the millimeter wave in that the SNR is low due to the low device output and high transmission loss in the free space, using the new RF transmission technique and antenna system. In the 3-dimensional beam steering system of the present invention, the power of the receiving signal increases according to the beam focusing effect, and directional fading caused in the conventional smart antenna is avoided. Additionally, interference from other transmitters located at different distances, and noise, can be prevented, resulting in reduction of the whole noise level. Accordingly, a considerable SNR enhancement is expected. Since the individual antenna element of the 3-dimensional beam steering antenna system can steer the beam in 1-, 2-, and 3-dimensions, the 3-dimensional beam steering technique of the present invention can be applied in both the microwave and millimeter bands. Furthermore, the 3-dimensional beam steering technique will contribute to RF c system research by solving the low SNR problem in the millimeter wave technology, and integration of the optical and microwave technologies. Also, this will effect and offer tremendous development capability to various technical fields such as 3-dimensional imaging, space engineering, astronomy, etc. using millimeter waves, as well as broad band communication.

Still more, in the 3-dimension beam steering technique of the present invention, there is no need to use high output power devices and amplifiers that are used in the conventional antenna system, and the antenna elements and passive devices of the system are mass-produced using MEMS technology, resulting in reduction of manufacturing costs of the components for millimeter wave communication, and in competitiveness in the antenna system market.

What is claimed is:

1. A beam steering system having a front surface and comprising at least two beam steering devices on the front surface, each including an antenna unit and an individual driving unit capable of electrically and mechanically steering the antenna units, the beam steering devices being arranged to focus the beam at one spatial point.

2. A beam steering system of claim 1, wherein the driving unit can mechanically steer the antenna unit in 1 and 2 dimensions in order for a beam to be 1-, 2-, and 3-dimensionally guided.

3. A beam steering system of claim 1 is characterized in that the system operates in microwave and millimeter wave bands.

4. A beam steering system of claim 1 further comprises a MMIC-type active circuit exchanging signals with the beam steering device.

5. A beam steering system of claim 4, wherein the MMIC-type active circuit comprises a VCO, a mixer, an amplifier.

6. A beam steering system of claim 4, wherein the MMIC-type active circuit and the beam steering device are monolithically integrated using a quasi-optical technology or a multi-level integration technology.

7. A beam steering system of claim 1 further comprises a phase shifter connected to the beam steering device for electrically adjusting a phase of a signal to be transmitted through the antenna unit.

8. A beam steering system of claim 1, wherein the beam steering device uses an electrical method for adjusting a phase of the antenna unit, and a mechanical method for physically adjusting a direction of the antenna unit for beam steering.

9. A beam steering system of claim 1, wherein components of the beam steering system are manufactured using a micromachining technology.

10. An antenna for three dimensional beam steering, the antenna having a front surface and comprising an array of individually controlled beam generating elements on the front surface, each beam generating clement being associated with an individual driving unit capable of electrically and mechanically steering the beam generating element, the beam generating elements being arranged to focus the beam at one spatial point.

* * * * *